United States Patent [19]

Ott

[11] 4,040,623

[45] Aug. 9, 1977

[54] TETHERED BALL AND LOOP TOY OR EXERCISING DEVICE

[76] Inventor: Howard E. Ott, 280 W. Kenneth Road, Glendale, Calif. 91202

[21] Appl. No.: 712,235

[22] Filed: Aug. 6, 1976

Related U.S. Application Data

[63] Continuation-in-part of Ser. No. 639,626, Dec. 11, 1975, abandoned.

[51] Int. Cl.[2] ..... A63B 67/10

[52] U.S. Cl. ..... 273/98; 273/95 A

[58] Field of Search ..... 273/95 A, 97 R, 98

[56] References Cited

U.S. PATENT DOCUMENTS

| | | | |
|---|---|---|---|
| 834,077 | 10/1906 | Reiter | 273/95 A |
| 2,105,462 | 3/1937 | Brinkman | 273/97 R |
| 2,246,041 | 6/1941 | Halberstadter | 273/98 |
| 2,414,063 | 1/1947 | Rogers | 273/97 R |
| 3,679,204 | 7/1972 | Busby | 46/47 |

FOREIGN PATENT DOCUMENTS

| | | | |
|---|---|---|---|
| 743,135 | 1933 | France | 273/97 R |
| 2,321,305 | 11/1973 | Germany | 273/97 R |

*Primary Examiner*—Richard C. Pinkham
*Assistant Examiner*—Lawrence E. Anderson
*Attorney, Agent, or Firm*—Keith D. Beecher

[57] ABSTRACT

A toy or exercising device is provided in the form of a frame and a ball tethered to one end of the frame. The frame may be grasped at either end and the object of the device is to revolve the ball or the frame about an axis at one end of the frame in a manner so that the ball repeatedly passes through an intermediate loop formed by the frame without touching the sides of the loop.

2 Claims, 5 Drawing Figures

TETHERED BALL AND LOOP TOY OR EXERCISING DEVICE

This application is a continuation-in-part of copending application Ser. No. 639,626, filed Dec. 11, 1975, now abandoned.

BACKGROUND OF THE INVENTION

The device of the invention is intended as a toy by which the user may test his skill and coordination, and it also serves as a means for exercising and strengthening the wrist muscles of the user. The device is advantageous in that it may be constructed simply and inexpensively, and in that it provides a simple means whereby the user can amuse himself and gain physical benefit thereof.

DETAILED DESCRIPTION OF THE ILLUSTRATED EMBODIMENTS

Figure 1:
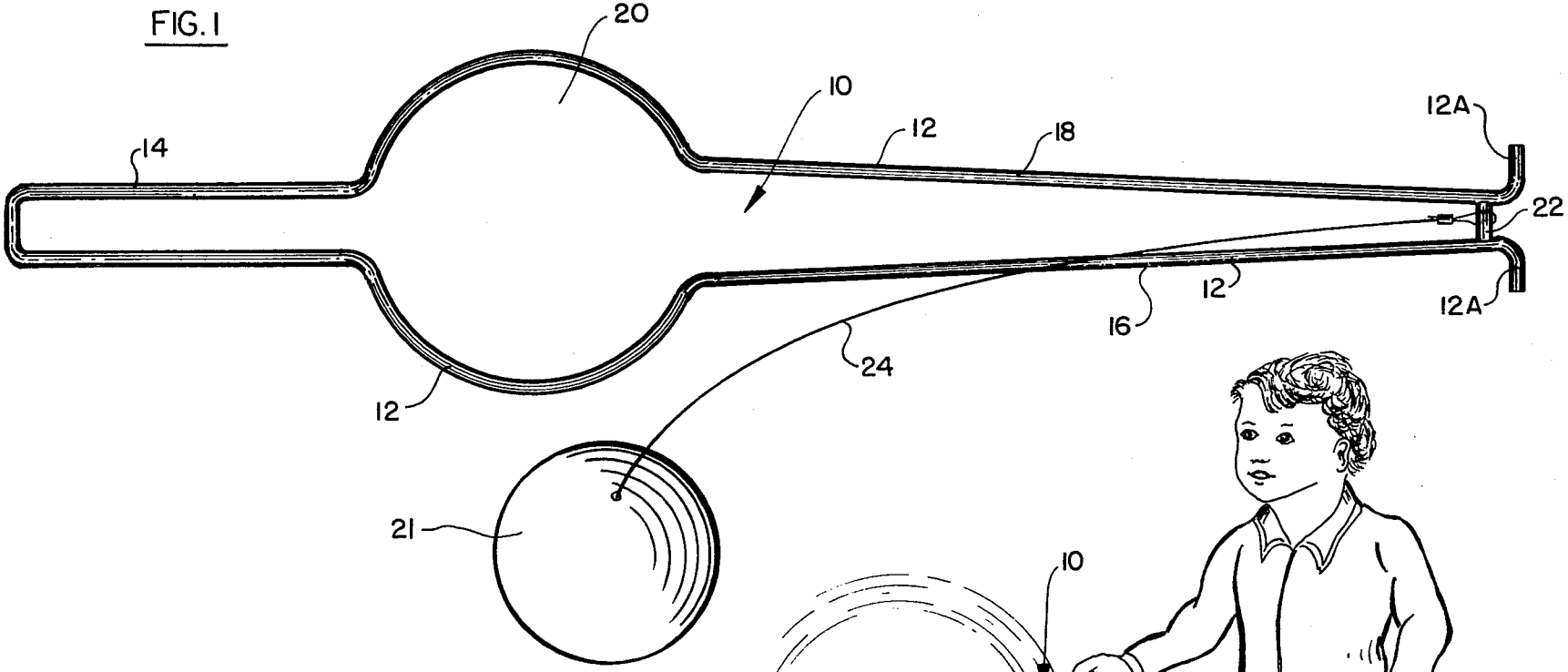
FIG. 1 is a top plan view of the tethered ball and loop toy or exercising device constituting one embodiment of the invention.

The device illustrated in FIG. 1 of the drawing includes a frame member 10 which is formed of a rigid wire 12, or other appropriate material. The wire 12 is bent at one end of the device to form a handle means 14, and also to form two spaced sides 16 and 18. The sides 16 and 18 are spaced from one another, as shown, and the wire is further configured to form an intermediate loop 20. The extremities **12*a* of the wire are bent outwardly at the right-hand end in FIG. 1** to constitute secondary handles for the device.

A ball 21 is tethered to a rigid transverse wire 22 at the right-hand end of the frame member by means of a flexible line 24. The end of the flexible line 24 is looped around the wire 22, so that the wire 22 may function as a bearing for the line.

Figure 2:
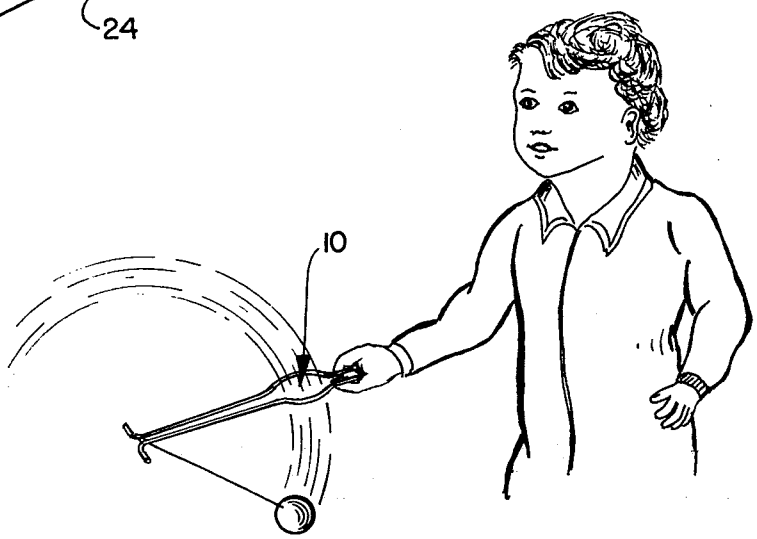
FIG. 2 shows the device of FIG. 1 in actual use.

When the device of FIG. 1 is grasped at the handle means, as shown in FIG. 2, and moved rapidly upwardly and downwardly, the ball 21 is caused to revolve about the axis of the wire 22. The length of the line 24 is selected so that the ball, when so revolved, will pass through the loop 20.

The object, of course, is to manipulate the frame member in such a way that the ball 21 will either oscillate about the axis of the wire 22, or revolve about the axis of the wire 22, and repeatedly pass through the loop 20, without touching the sides of the frame.

As stated above, the extremities **12*a* of the wire 12 form a secondary handle means, and the device may be grasped between the thumb and forefinger of each hand at the right-hand end, if so desired, so as to manipulate the device. The device, when grasped either at the end of handle means 14, or by the extremities 12*a*, may be manipulated either in a vertical or horizontal plane, as desired, to cause the ball 21 to oscillate or revolve about the axis of wire 22 and through the loop 20**.

Figure 3:
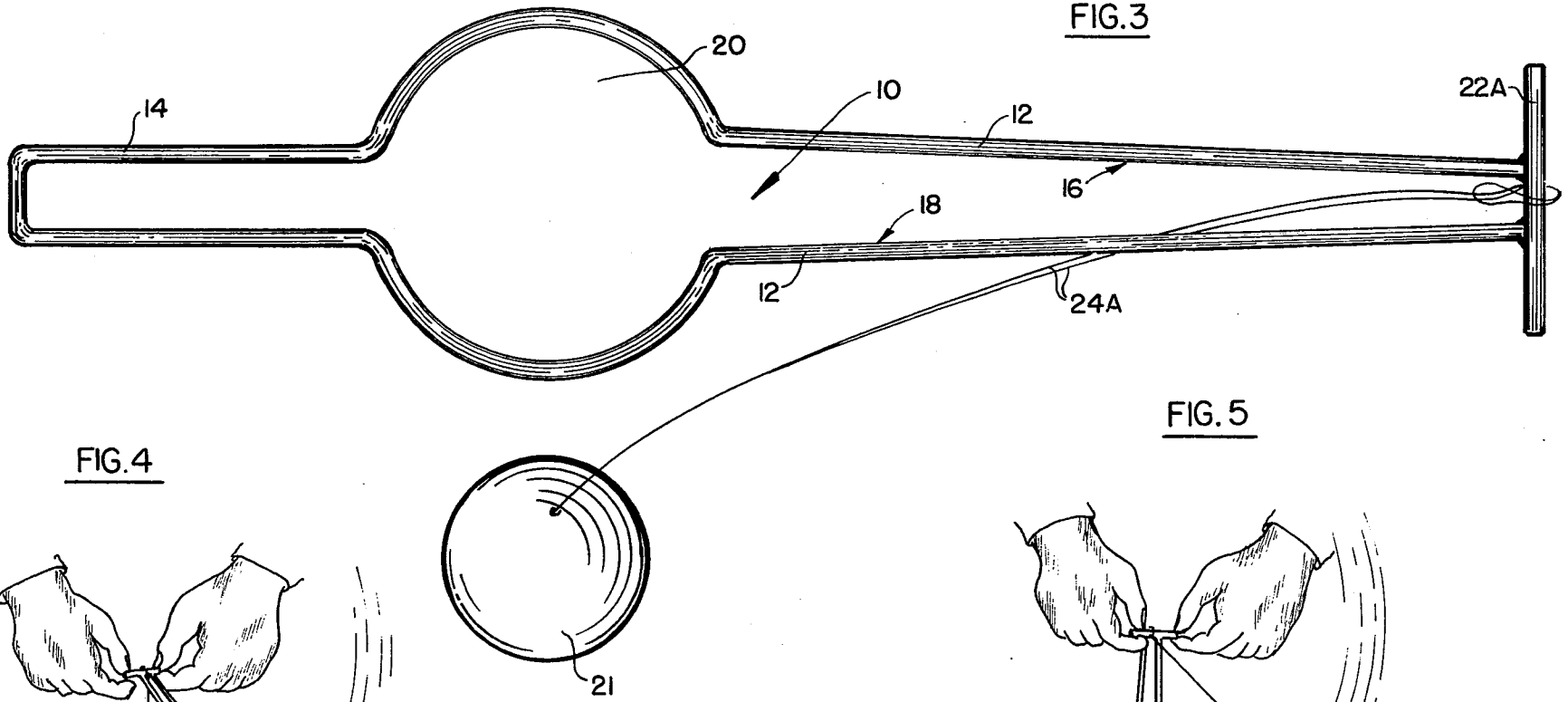
FIG. 3 is a top plan view of a second embodiment of the invention.

The embodiment of FIG. 3 is generally similar to that of FIG. 1, and like components have been designated by the same numerals. In the embodiment of FIG. 3, the wire 22 of FIG. 1 has been designated 22A, and it also forms the secondary handles at the right-hand end of the device. The extremities of the wire 12 are welded, or otherwise attached to the wire 22A. Also, in the latter embodiment the flexible line 24 of the device of FIG. 1 consists of a loop 24A which permits the ball to be tethered to the wire 22A in the illustrated manner, so that the ball and line may be removed easily and replaced, as the line 24A becomes worn.

Figure 5:
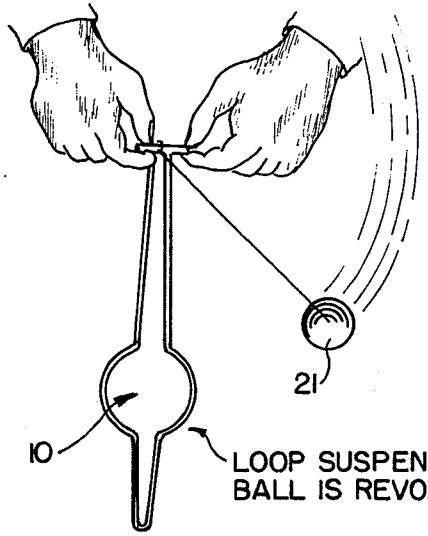
FIGS. 4 and 5 show the embodiment of FIGS. 1 or 2 in actual use in a different manner from FIG. 3.
Figure 4:
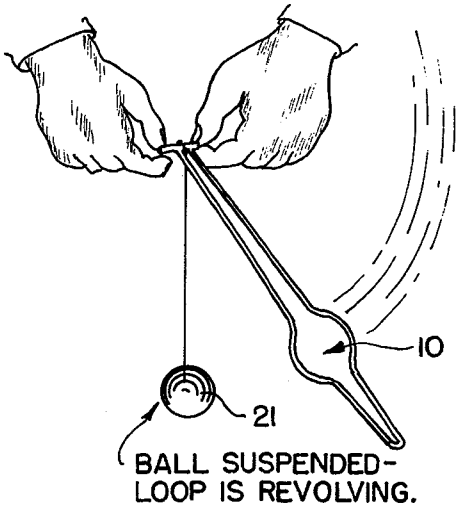

Also, as shown in FIGS. 4 and 5, the device of the invention may be grasped by the secondary handles, and the frame may be rotated with the ball held stationary, as shown in FIG. 4; or the ball may be rotated with the frame held stationary, as shown in FIG. 5.

It will be appreciated that although particular embodiments of the invention have been shown and described, modifications may be made. It is intended in the claims to cover the modifications which come within the spirit and scope of the invention.

What is claimed is:

1. A toy and exercising device comprising: an elongated frame member formed of a continuous wire bent at one end into a U-shaped configuration to define a first pair of sides spaced from one another to form a handle for the device, and said wire further defining a second pair of sides at the other end of the device spaced from one another, and further defining an intermediate loop, the first and second pairs of sides being spaced apart a distance less than the diameter of said loop; a ball; a further wire extending transversely across the frame-like member at the end thereof remote from said handle means; and a flexible line secured to said further wire for tethering said ball to said frame, said line having a length to permit the ball and the frame to be turned relative to one another about the axis of said further wire to permit the ball to pass through the intermediate loop, in which the extremities of the first-named wire at said remote end of the frame are bent outwardly in substantial axial alignment with the further wire to provide secondary handles for the device.

2. A toy and exercising device comprising: an elongated frame member formed of a continuous wire bent at one end into a U-shaped configuration to define a first pair of sides spaced from one another to form a handle for the device, and said wire further defining a second pair of sides at the other end of the device spaced from one another, and further defining an intermediate loop, the first and second pairs of sides being spaced apart a distance less than the diameter of said loop; a ball; a further wire extending transversely across the frame-like member at the end thereof remote from said handle means; and a flexible line secured to said further wire for tethering said ball to said frame, said line having a length to permit the ball and the frame to be turned relative to one another about the axis of said further wire to permit the ball to pass through the intermediate loop, in which said further wire extends outwardly beyond the second pair of sides to provide secondary handles for the device.

* * * * *